US010504350B2

(12) United States Patent
Weksler et al.

(10) Patent No.: US 10,504,350 B2
(45) Date of Patent: Dec. 10, 2019

(54) CROWD SOURCED THEFT DETERRENT FOR NEIGHBORHOODS

(71) Applicant: Lenovo (Singapore) Pte. Ltd., Singapore (SG)

(72) Inventors: Arnold S. Weksler, Raleigh, NC (US); Nathan J. Peterson, Durham, NC (US); John Carl Mese, Cary, NC (US); Russell Speight VanBlon, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 253 days.

(21) Appl. No.: 14/922,785

(22) Filed: Oct. 26, 2015

(65) Prior Publication Data

US 2017/0116838 A1 Apr. 27, 2017

(51) Int. Cl.
*G08B 15/00* (2006.01)
*G08B 27/00* (2006.01)

(52) U.S. Cl.
CPC ..... *G08B 15/00* (2013.01); *G08B 27/003* (2013.01)

(58) Field of Classification Search
CPC . G08B 15/00; G08B 27/003; G08B 13/19695
See application file for complete search history.

(56) References Cited

U.S. PATENT DOCUMENTS 8,957,588 B1 * 2/2015 Ericksen ..... H05B 37/0218 315/149
2004/0036603 A1 * 2/2004 Bingham ..... G08B 13/19628 340/541
2015/0154850 A1 * 6/2015 Fadell ..... G06Q 10/083 340/501

* cited by examiner

*Primary Examiner* — Neil R Mikeska
(74) *Attorney, Agent, or Firm* — Ference & Associates LLC

(57) ABSTRACT

One embodiment provides a method including: detecting, using a motion detection device, a movement at a first location; responsive to the detecting, turning on at least one light source at the first location; and responsive to the detection, turning on at least one other light source at a second location; wherein the first location is separately networked from the second location. Other aspects are described and claimed.

20 Claims, 4 Drawing Sheets

CROWD SOURCED THEFT DETERRENT FOR NEIGHBORHOODS

BACKGROUND

Unfortunately, crime in some form exists in every pocket of society. Thus, there will always be a need to protect loved ones and property. Many tools currently exist for helping to ensure a home's security, such as: gated communities, private security patrols, security systems, guard dogs, and exterior lighting. Exterior lighting has always been one of the most effective means of crime/theft deterrent for residential homes. Lighting the exterior of a residence (e.g., the driveway, front porch, front yard, back yard, etc.) dissuades potential thieves, as they are likely to be visible, and thus more likely to be seen by the resident or neighbor, who can then alert the authorities.

Although home security systems have become more complex and capable, they can be expensive to install and maintain (e.g., monthly/annual service charges.) Additionally, although various methods of stand alone outdoor lighting (e.g., porch lights, dusk to dawn lights, motion lights, etc.) have existed for many years, improvement is still possible.

BRIEF SUMMARY

In summary, one aspect provides a method, comprising: detecting, using a motion detection device, a movement at a first location; responsive to the detecting, turning on at least one light source at the first location; and responsive to the detection, turning on at least one other light source at a second location; wherein the first location is separately networked from the second location.

Another aspect provides an information handling device, comprising: a processor; a motion detection device; a memory device that stores instructions executable by the processor to: detect, using the motion detection device, a movement at a first location; responsive to the detecting, turn on at least one light source at the first location; and responsive to the detection, turn on at least one other light source at a second location; wherein the first location is separately networked from the second location.

A further aspect provides a product, comprising: a storage device having code stored therewith, the code being executable by a processor and comprising: code that detects, using a motion detection device, a movement at a first location; code that responsive to the detecting, turns on at least one light source at the first location; and code that responsive to the detection, turns on at least one other light source at a second location; wherein the first location is separately networked from the second location.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
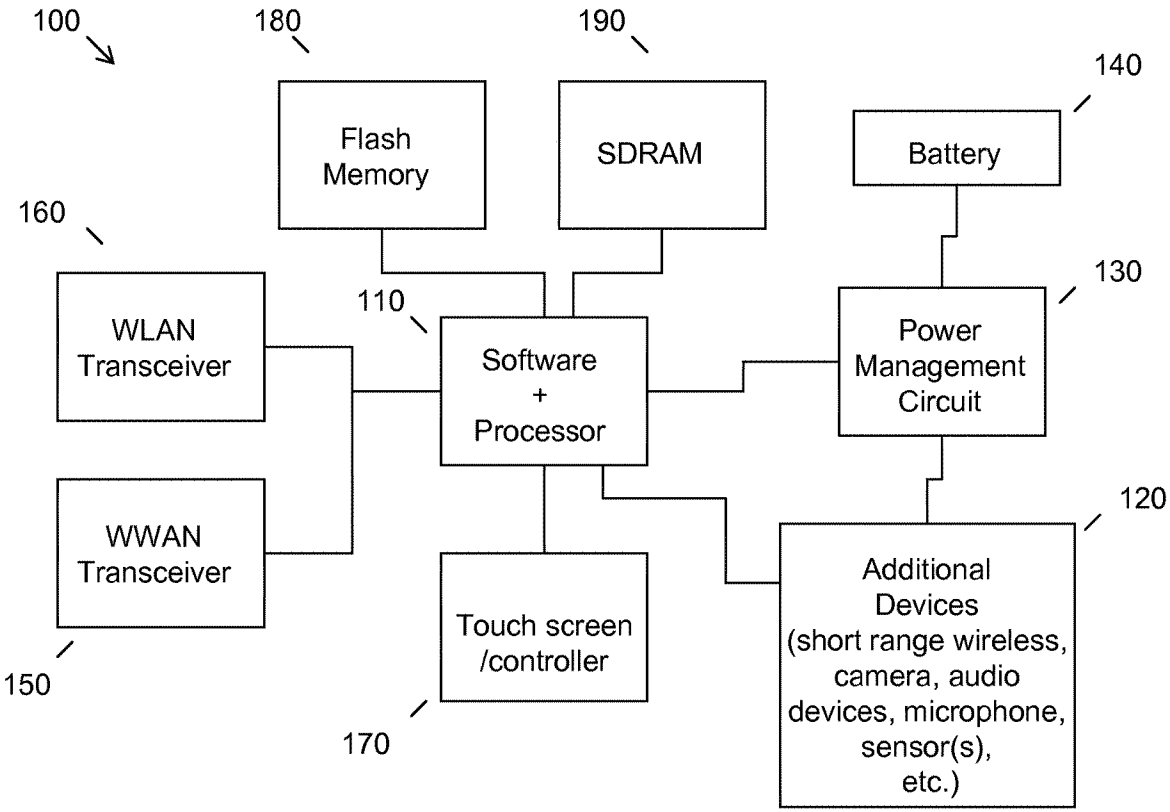
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Outdoor lighting is one of the most efficient methods of intrusion deterrent. The ability to clearly see a specific area (e.g., a portion of property) enables owners and neighbors to see a potential crime before it takes place. In fact light is such an effective deterrent, that many homeowner associations require their neighborhood residences to leave their outdoor lights on twenty four hours a day, seven days a week in order to help create a unified defense against crime in their area. Generally, however, people do not want to take this action because of the added electrical costs associated with leaving multiple exterior lights around the clock.

For many years, the solution to this problem has been motion activated lighting. A wide variety of motion-sensing lights exist today; however, they are typically only available in a stand alone implementation (e.g., a motion sensor for a single light source, or set of light sources on a single switch. Thus, although the motion detecting light sources solve the electrical cost problem, the overall results is still an overly dark neighborhood with the occasional single residential exterior lit. Thus, a solution is needed that grants the benefits of the stand alone motion lights with the theft deterrence benefits of total neighborhood illumination.

Accordingly, an embodiment provides a method of utilizing a crowd source approach, wherein neighborhood appliances (e.g., lights, cameras, etc.) may be used together to deter potential criminal activity. Thus, although as stated, neighborhood devices such as outside lights or cameras may be temporarily activated to assist with theft deterrence, a technical improvement to the operational features (e.g., communication between the devices) would further assist with theft deterrence. For example, if a device associated with household A senses outdoor motion (e.g., a potential burglar), it then turns on not only household A's lights (e.g., interior and/or exterior), but also the lights (e.g., interior and/or exterior) of other households in the area. Through this method, the benefit of a broader secure environment is achieved. Moreover, the increase in the electrical bill (associated with having the lights on constantly) is also avoided.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are commonly included, e.g., an image sensor such as a camera. System 100 often includes a touch screen 170 for data input and display/rendering. System 100 also typically includes various memory devices, for example flash memory 180 and SDRAM 190.

Figure 2:
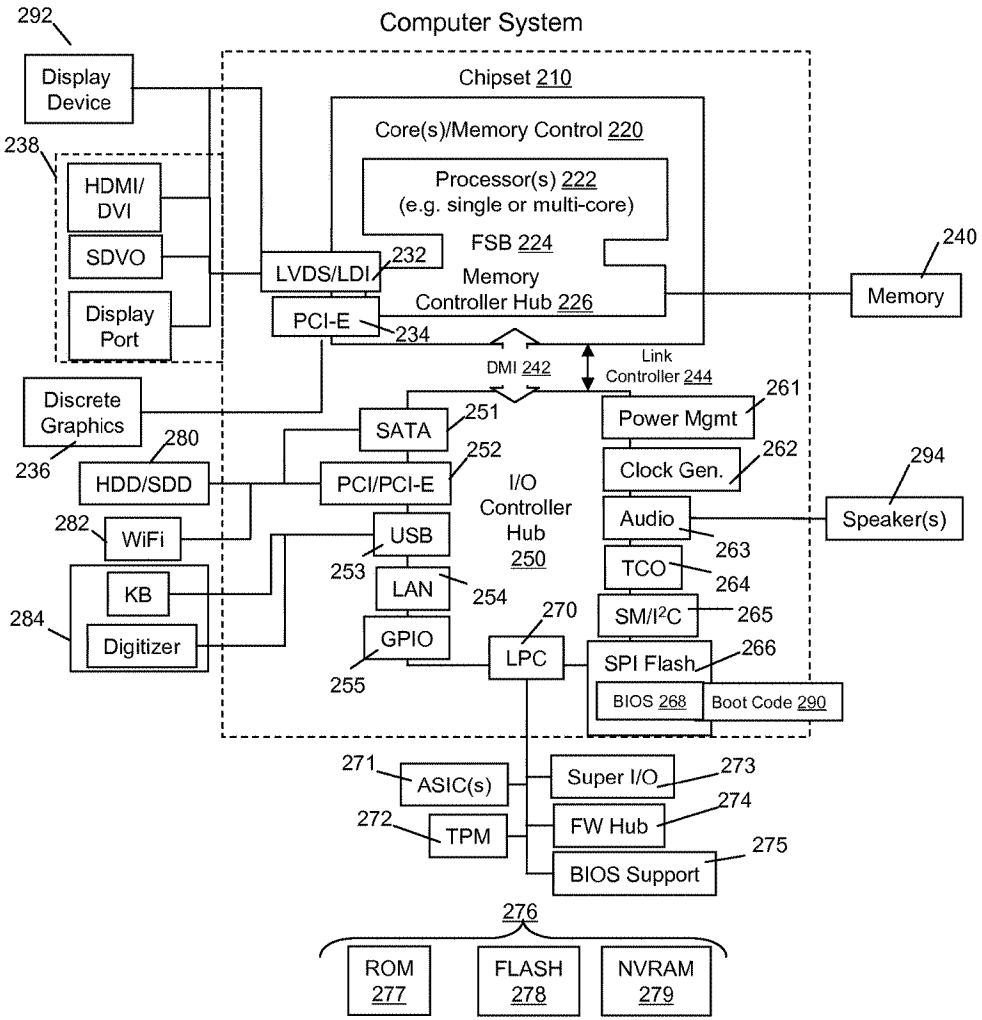
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in devices such as tablets, smart phones, personal computer devices generally, and/or electronic devices which users may use to manage or modify theft deterrent devices (e.g., lights, cameras, etc.) For example, the circuitry outlined in FIG. 1 may be implemented in a tablet or smart phone embodiment, whereas the circuitry outlined in FIG. 2 may be implemented in a personal computer embodiment.

Figure 3:
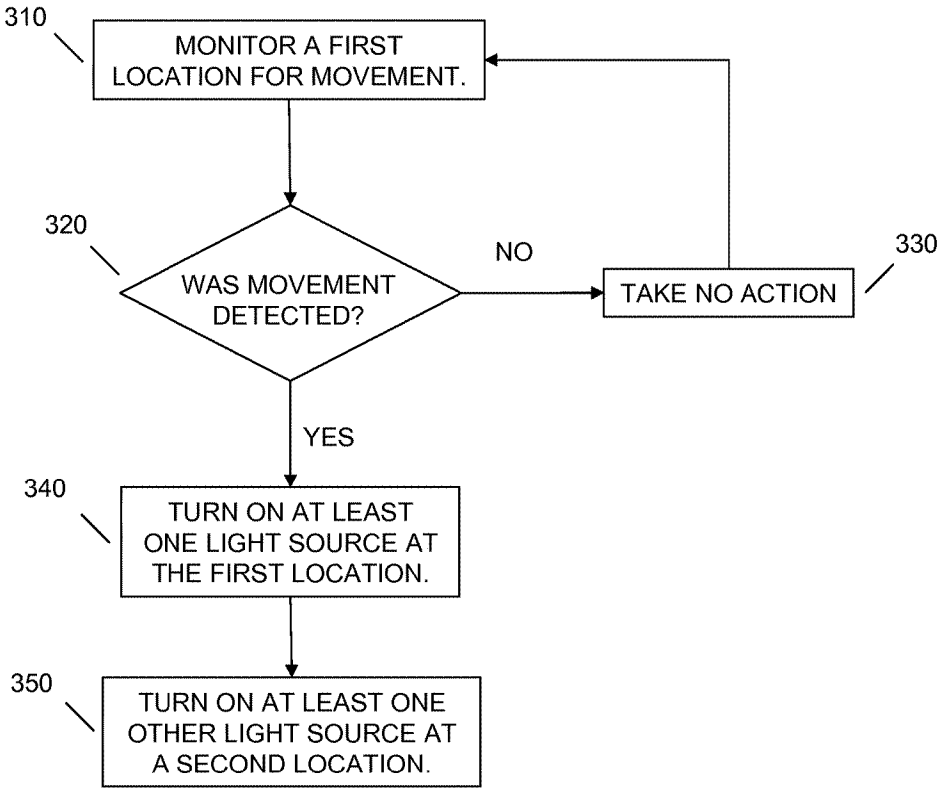
FIG. 3 illustrates an example method of crowd sourced theft deterrent.

Referring now to FIG. 3, an embodiment may monitor a first location (e.g., the exterior of a residence) for movement (e.g., a potential burglar walking through the yard) at 310. The monitoring system may consist of a single monitoring location, or multiple monitoring locations spread around a property. For example, a residence may be gated and only allow access via one entry point, thus only that entry point may need monitoring. Alternatively, another residence may be accessible from multiple directions and thus need to be monitored on each side and at varying distances.

In one embodiment, the motion detection device may be any of a plurality of technologies. For example, the motion detection device may utilize: passive infrared, microwaves, ultrasonic sensors, tomographic motion detection, video or image capture devices, etc. Additionally or alternatively, the motion detection device may be a dual-technology device or even a multi-technology device (e.g., incorporating a plurality of the above listed technologies). If an embodiment does not detect movement at 320, no action is taken at 330, and the embodiment continues to monitor the first location for movement at 310.

Alternatively, if motion is detected at 320, an embodiment may turn on at least one light source at the first location at 340. A further embodiment may then subsequently or simultaneously turn on at least one other light source at a second location. For example, if a motion is detected in the yard of a first residence (e.g., a first location) it may cause a light or camera associated with the first residence to be activated. Additionally, in order to further improve the effectiveness of the theft deterrent, additional lights or cameras may be activated that are associated with other residences (e.g., secondary locations) at 350. The other devices (e.g., lights and/or cameras) at the secondary locations may be activated in various ways. For example, the devices may be activated and run continuously until a user manually toggles them off. Alternatively, the devices may only toggle on for a predetermined amount of time and once that time passes with no additional detected movements, the devices toggle off. Further, an embodiment may only flash the secondary lights a predetermined number of times upon detection of movement.

As a further example, an embodiment may exist in a suburban neighborhood setting. A motion detection device in yard A of the neighborhood detects movement upon the property. As a result, yard A is illuminated as well as each adjacent neighbor's yard. The illumination of adjacent residences not only reduces possible escape routes for a potential thief, but also demonstrates the cooperative nature of the neighborhood. It also increases the likelihood of attracting the attention of individuals (e.g., neighbors) who may respond appropriately (e.g., calling the police). For example, a home owner might not be alarmed if their neighbors flood lights illuminate, however, if the lights within their own yard illuminate they are far more likely to investigate the disturbance and thus witness the potential theft.

A further embodiment may require a secondary, or additional, detection at the first location at 310 prior to turning on the at least one other light source at the second location at 350. For example, an embodiment may detect movement in residence A's yard, and in response only activate one or more lights or cameras associated with residence A. This allows for a progressive escalation of theft deterrent. Thus, once a second motion is detected at either residence A or residence B, an embodiment can determine that the potential threat was not deterred and activate the one or more lights or cameras associated with other residences (e.g., all adjacent neighbors, all neighbors in a block radius, a predetermined and assigned group of neighbors, etc.).

An embodiment may allow the various devices associated with each residence to be connected to each other in a variety of ways. Moreover, the connections may be between devices themselves, or between the devices and a centralized server. For example, the residences may be interconnected via: a wireless wide area network (WAN), wireless local area network (LAN), or any standard transmission control protocol/internet protocol (TCP/IP) communication method. Additionally or alternatively, the residences may have a cellular connection as either the primary connection, or as a redundancy to an additional communication method. An embodiment may also use power-line communication, or any known method of data transmission to illuminate or record the additional residences (e.g., secondary locations) via their associated devices. In a further embodiment, each light or camera may be assigned an individual or unique identifier address, in order to allow customized activation settings.

Therefore, because an embodiment utilizes its own form of communication and can manipulate the other device in a standalone fashion, it does not require the use of a more complicated and expensive security system. Typically, a security system is required to connect and manage large scale home lighting options. Additionally, because each residence is isolated (e.g., on a separate electrical service drop, using separate internet service providers) it is complex and costly to attempt to combine various security systems owned by various residences.

Figure 4:
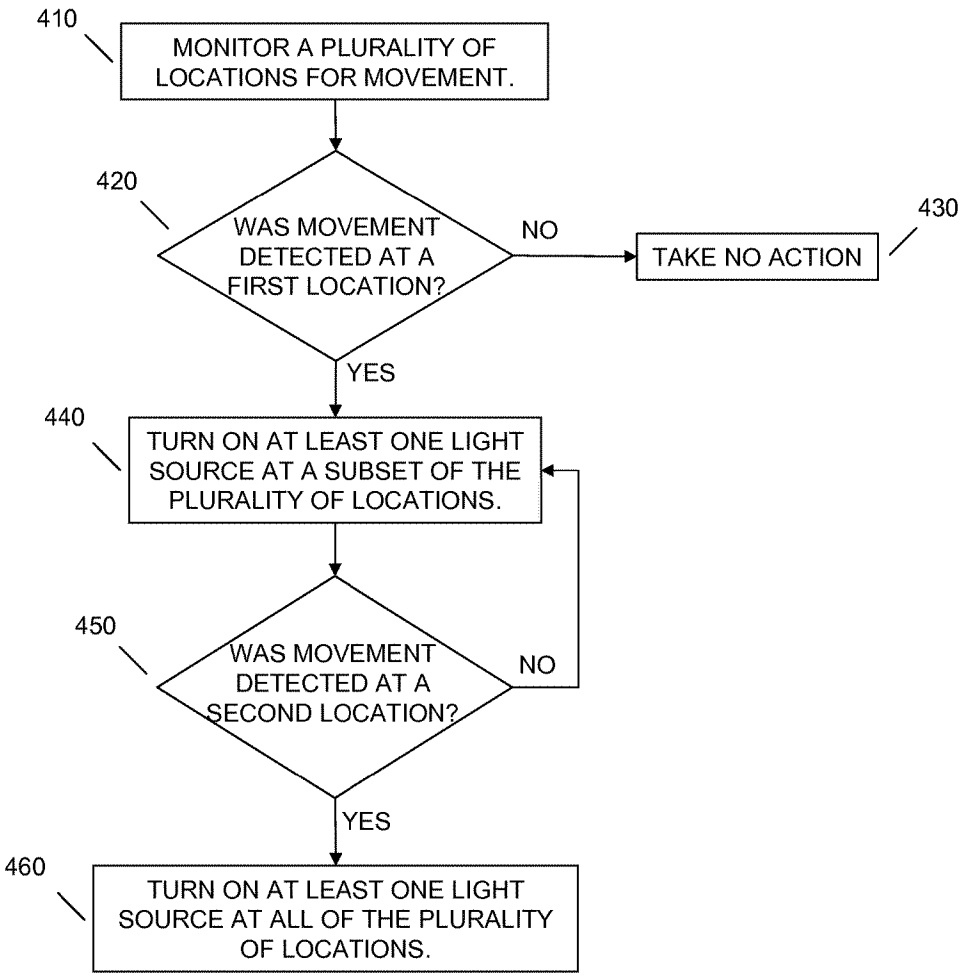
FIG. 4 illustrates another example method of crowd sourced theft deterrent.

Referring now to FIG. 4, once a plurality of residences are interconnected, it may be desired to light more than a single residence, but less than the entire plurality. Thus creating zones that can be activated independently of each other, or in combination with each other. An embodiment may monitor a plurality of locations for movement at 410. Similar to FIG. 3, if no motion is detected at 420, no action is taken at 430. However, if movement is detected at first location at 420, an embodiment may turn on at least one light source at a subset of the plurality of monitored locations. For example, if a motion is detected at a first residence, an embodiment may illuminate all of the light fixtures on that residence, as well as any light fixtures on immediately adjacent residences at 440. This first set of residences may be identified as a group (e.g., group A).

A further embodiment may then detect movement at a second location at 450. The embodiment may require the secondary movement to take place within a predetermined time interval following the first detected motion. For example, assuming a motion was detected at a first residence, a subsequent motion may be detected three houses down (from the first residence), and within five minutes of the first detection. As long as, the second residence (three houses down) is still within the plurality of monitored residences (e.g., the same neighborhood) an embodiment may activate at least one light or camera at an even larger number of residences (e.g., group A and group B, or the entire plurality of monitored residences) at 460. Thus, an embodiment may scale the crowd sourced theft deterrent by initially only illuminating a subset of the interconnected residences, and responding with greater activation based on continued detection of movement.

Accordingly, as illustrated by the example embodiments and figures, an embodiment monitors a first location for movement. If the embodiment detects movement, at least one light or camera associated with the first location is activated. A further embodiment may then also activate at least one light or camera associated with a second location. The secondary activation may be based on further motion detection, or may be activated based solely on the original motion detection.

The various embodiments described herein thus represent a technical improvement to theft deterrent by activating theft deterrent systems across multiple residences in as intelligent fashion. Thus, an embodiment may monitor multiple residences for movement. If movement is detected at one of the residences, an embodiment may activate at least one theft deterrent device (e.g., a light, a camera, etc.) associated with a group of residences. For example a residence whose property the motion was detected on, and a local grouping of nearby neighbors. A further embodiment may then continue monitoring the full plurality of residences for motion and upon subsequent detection, activate a larger portion of the theft deterrent devices associated with the plurality of residences. For example, upon the secondary detection, illuminating the entirety of the neighborhood instead of the limited local cluster initially activated.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, an electronic, magnetic, optical, electromagnetic, infrared, or semiconductor system, apparatus, or device, or any suitable combination of the foregoing. More specific examples of a storage medium would include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising:

detecting, using a motion detection device, a movement of a threat at a first location, wherein the first location is associated with a first structure, wherein the threat defines a center point within a radius;

responsive to the detecting, turning on at least one light source at the first location; and responsive to the detecting, turning on at least one other light source at a second location within the radius of the threat, wherein the second location is associated with a second structure separate from the first structure and the turning on of the at least one other light source at a second location is based upon the movement at the first location and the center point and the radius are dynamically adjusted based upon a location of the threat as the threat moves;

wherein the first location is separately networked from the second location.

2. The method of claim 1, wherein the first location is a first residence; and wherein the second location is a second residence.

3. The method of claim 1, wherein the first location and second location are powered by separate electrical service drops; and wherein the at least one light source and the at least one other light source are not connected to a home security system.

4. The method of claim 1, further comprising:

responsive to the detecting, turning on at least one video capture device at the first location; and responsive to the detection, turning on at least one other video capture device at a second location.

5. The method of claim 1, wherein the first location and the second location are connected via at least one of: cellular network, wireless wide area network, wireless local area network, transmission control protocol, internet protocol, power line communication, and fiber optics.

6. The method of claim 1, wherein the turning on at least one other light source comprises flashing on and off the at least one other light source a predetermined number of times.

7. The method of claim 1, further comprising:

detecting, using the motion detection device, a second movement at the first location;

wherein the turning on at least one other light source at the second location is responsive to the detection of the second movement.

8. The method of claim 1, wherein the second location comprises a plurality of residences; and wherein the first location comprises a subset of the plurality of residences.

9. The method of claim 8, further comprising:

detecting, using a motion detection device, a second movement at a residence within the subset, independent of a residence associated with a first detection; and responsive to the detection of the second movement, turning on a plurality of light sources associated with the plurality of residences.

10. The method of claim 1, wherein each at least one light source and each at least one other light source are assigned a unique address.

11. An information handling device, comprising:

a processor;

a motion detection device;

a memory device that stores instructions executable by the processor to:

detect, using the motion detection device, a movement of a threat at a first location, wherein the first location is associated with a first structure, wherein the threat defines a center point within a radius;

responsive to the detecting, turn on at least one light source at the first location; and responsive to the detection, turn on at least one other light source at a second location within the radius of the threat, wherein the second location is associated with a second structure separate from the first structure and the turning on of the at least one other light source at a second location is based upon the movement at the first location and the center point and the radius are dynamically adjusted based upon a location of the threat as the threat moves;

wherein the first location is separately networked from the second location.

12. The information handling device of claim 11, wherein the first location is a first residence; and wherein the second location is a second residence.

13. The information handling device of claim 11, wherein the first location and second location are powered by separate electrical service drops; and wherein the at least one light source and the at least one other light source are not connected to a home security system.

14. The information handling device of claim 11, wherein the instructions are further executable to:

responsive to the detecting, turn on at least one video capture device at the first location; and responsive to the detection, turn on at least one other video capture device at a second location.

15. The information handling device of claim 11, wherein the first location and the second location are connected via at least one of: cellular network, wireless wide area network, wireless local area network, transmission control protocol, internet protocol, power line communication, and fiber optics.

16. The information handling device of claim 11, wherein the turning on at least one other light source comprises flashing on and off the at least one other light source a predetermined number of times.

17. The information handling device of claim 11, wherein the instructions are further executable to:

detect, using the motion detection device, a second movement at the first location;

wherein the turning on at least one other light source at a second location is responsive to the detection of the second movement.

18. The information handling device of claim 11, wherein the second location comprises a plurality of residences; and wherein the first location comprises a subset of the plurality of residences.

19. The meth information handling device of claim 18, wherein the instructions are further executable to:

detect, using a motion detection device, a second movement at a residence within the subset, independent of a residence associated with a first detection; and responsive to the detection of the second movement, turn on a plurality of light sources associated with the plurality of residences.

20. A product, comprising:

a storage device having code stored therewith, the code being executable by a processor and comprising:

code that detects, using a motion detection device, a movement of a threat at a first location, wherein the first location is associated with a first structure, wherein the threat defines a center point within a radius;

code that responsive to the detecting, turns on at least one light source at the first location; and code that responsive to the detection, turns on at least one other light source at a second location within the radius of the threat, wherein the second location is associated with a second structure separate from the first structure and the turning on of the at least one other light source at a second location is based upon the movement at the first location and the center point and the radius are dynamically adjusted based upon a location of the threat as the threat moves;

wherein the first location is separately networked from the second location.

* * * * *